US005594432A

United States Patent [19]

Oliva et al.

[11] Patent Number: 5,594,432

[45] **Date of Patent: *Jan. 14, 1997**

[54] TRAFFIC INFORMATION WARNING SYSTEM

[75] Inventors: David C. Oliva, Chicago; Max W. Rogers, Franklin Park, both of Ill.

[73] Assignee: Cobra Electronics Corp., Chicago, Ill.

[ * ] Notice: The term of this patent shall not extend beyond the expiration date of Pat. No. 5,497,148.

[21] Appl. No.: 564,468

[22] Filed: Nov. 29, 1995

Related U.S. Application Data

[63] Continuation-in-part of Ser. No. 297,969, Aug. 30, 1994, Pat. No. 5,497,148.

[51] Int. Cl.[6] ..... G08G 1/09

[52] U.S. Cl. ..... 340/905; 340/902; 340/903; 340/904; 340/906; 455/34.1; 455/34.2; 455/59

[58] Field of Search ..... 340/902, 903, 340/904, 906, 989; 455/34.1, 34.2, 59

[56] References Cited

U.S. PATENT DOCUMENTS

| | | | |
|---|---|---|---|
| 3,673,560 | 6/1972 | Barsh et al. | 340/33 |
| 3,772,641 | 11/1973 | Grosser et al. | 340/33 |
| 3,784,970 | 1/1974 | Simpkin | 340/33 |
| 4,024,475 | 5/1977 | Bragas et al. | 455/38.5 |
| 4,216,545 | 8/1980 | Flickshu et al. | 455/77 |
| 4,443,790 | 4/1984 | Bishop | 340/539 |
| 4,764,978 | 8/1988 | Argo et al. | 455/1 |
| 4,794,394 | 12/1988 | Halstead | 340/902 |
| 5,091,906 | 2/1992 | Reed et al. | 370/94.1 |
| 5,235,329 | 8/1993 | Jackson | 340/902 |
| 5,289,181 | 2/1994 | Watanabe et al. | 340/902 |
| 5,307,060 | 4/1994 | Prevulsky et al. | 340/902 |
| 5,497,148 | 3/1996 | Oliva | 340/905 |

*Primary Examiner*—Jeffery Hofsass
*Assistant Examiner*—Daryl C. Pope
*Attorney, Agent, or Firm*—Wallenstein & Wagner, Ltd.

[57] ABSTRACT

A traffic information warning system for conveying traffic information from a traffic advisory site to a vehicle is disclosed. The traffic warning site comprises an emergency vehicle, a roadside hazard, or the like. The system comprises a transmitter adapted for placement at the advisory site and a receiver adapted for placement at the vehicle. The transmitter includes a first oscillator for transmitting a first carrier signal having a first carrier frequency and a second oscillator for transmitting a second carrier signal having a second carrier frequency. The first carrier frequency and the second carrier frequency are spaced apart by a predetermined frequency difference. The transmitter also includes a modulator for modulating both carrier signals with an identical modulating signal reflective of a traffic situation. The receiver includes scanning circuitry, in the form of a microprocessor, for scanning across a predetermined frequency range to detect carrier signals separated by the predetermined frequency difference and a demodulator for retrieving a first retrieved modulating signal about the first carrier signal and a second retrieved modulating signal about the second carrier signal. The receiver also uses the microprocessor to compare the first retrieved modulating signal to the second retrieved modulating signal and to determine whether the first and second retrieved modulating signal are identical. Additionally, the receiver includes an announcing device for announcing a message regarding the traffic situation.

62 Claims, 4 Drawing Sheets

TRAFFIC INFORMATION WARNING SYSTEM

RELATED APPLICATION

This is a continuation-in-part of Ser. No. 08/297,969 filed Aug. 30, 1994, now U.S. Pat. No. 5,497,148.

TECHNICAL FIELD

Applicant's invention relates to a vehicular traffic information system which warns, or otherwise advises, motorists of various traffic hazards and conditions in their particular operating vicinity.

BACKGROUND PRIOR ART

Various systems have been proposed to inform motorists of traffic hazards. Some systems use modulated carrier signals to convey traffic information. Others, like the above-identified U.S. Pat. No. 5,497,148 assigned to the assignee of the present invention, use unmodulated carrier signals to convey traffic information.

Regardless of the type of system used, a problem exists in that the traffic information being communicated may either become distorted or otherwise compromised by interference from nearby signals. The present invention is provided to solve this and other problems.

SUMMARY OF THE INVENTION

It is an object of the invention to provide a traffic information warning system for conveying traffic information from a traffic advisor site to a vehicle. The traffic warning site may comprise an emergency vehicle, a roadside hazard, or the like.

In accordance with the invention, the system comprises a transmitter adapted for placement at the advisory site and a receiver adapted for placement in the vehicle.

The transmitter includes a first oscillator for transmitting a first carrier signal and a second oscillator for transmitting a second carrier signal. The first carrier signal has a first carrier frequency and the second carrier signal has a second carrier frequency. The transmitter further has a modulator for modulating both carrier signals with an identical modulating signal reflective of a traffic situation. The first carrier frequency and the second carrier frequency are spaced apart by a predetermined frequency difference.

In an embodiment of the invention, the receiver includes scanning circuitry, in the form of a programmed microprocessor, for scanning across a predetermined frequency range to detect carrier signals separated by the predetermined frequency difference. The receiver further includes a demodulator for retrieving a first retrieved modulating signal about the first carrier signal and a second retrieved modulating signal about the second carrier signal. The receiver also includes means for comparing the first retrieved modulating signal to the second retrieved modulating signal and determining whether the first and second retrieved modulating signals are identical. The receiver also has means for announcing a message regarding the traffic situation. It is contemplated that the announcing means includes a visual display, an audible device, or both.

In other embodiments of the invention, the basic components of the traffic information warning system are nearly the same; however, the structure and operation of the receiver's microprocessor differs.

Other features and advantages of the invention will be apparent from the following specification taken in conjunction with the following drawings.

DETAILED DESCRIPTION

Figure 1:
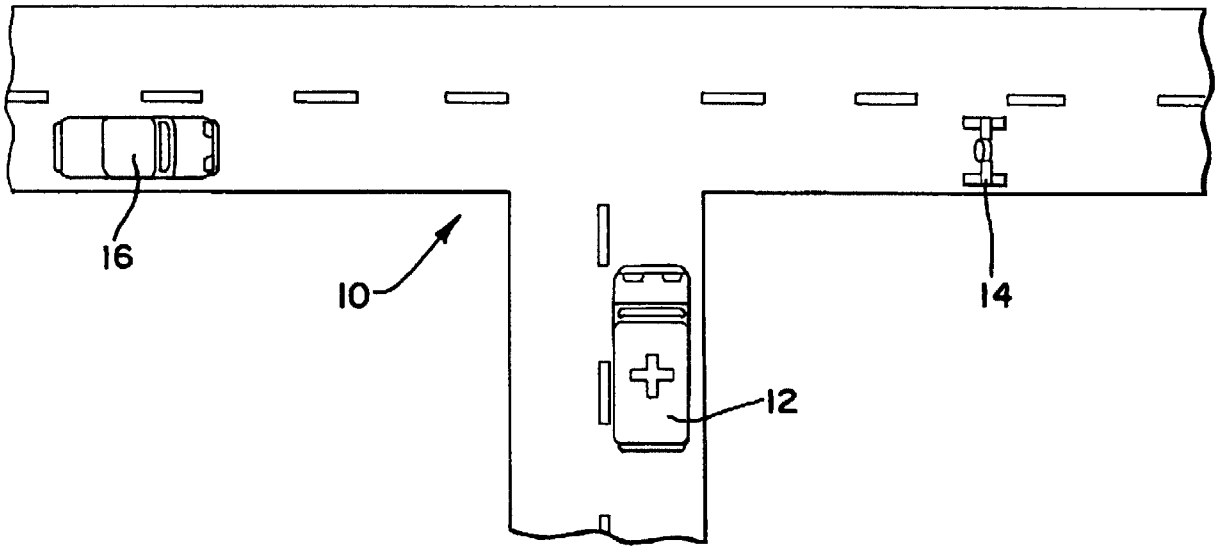
FIG. 1 is a schematic plan view of a traffic situation.

While this invention is susceptible of embodiments in many different forms, there is shown in the drawings and will herein be described in detail, preferred embodiments of the invention with the understanding that the present disclosure is to be considered as an exemplification of the principles of the invention and is not intended to limit the broad aspects of the invention to the embodiments illustrated.

Figure 2:
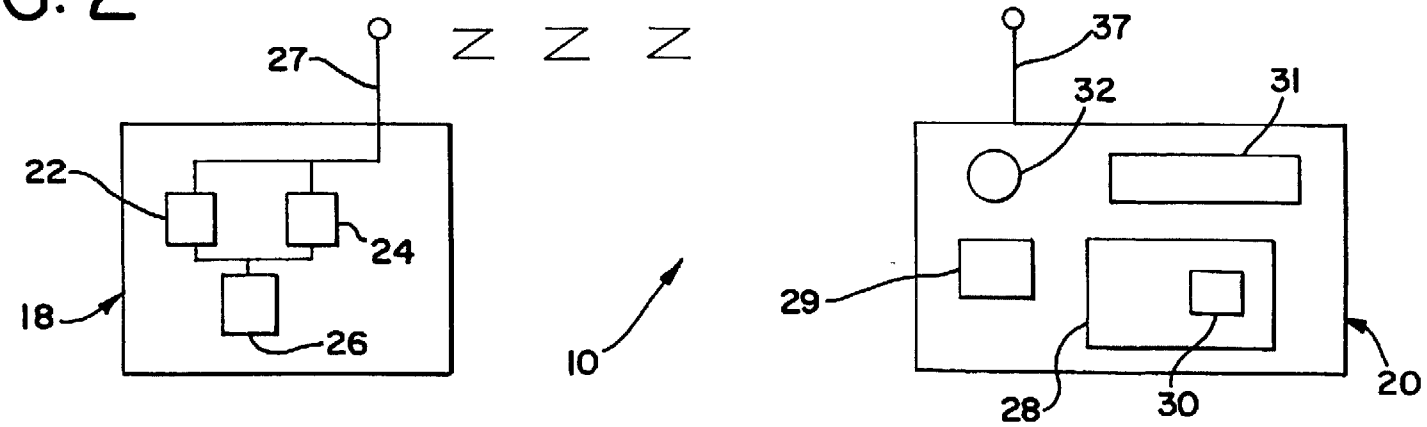
FIG. 2 is a block diagram of a transmitter and a receiver of a traffic hazard warning system in accordance with the invention.

A traffic information warning system, generally designated 10, for conveying a message regarding a traffic situation from a traffic advisory site, such as an emergency vehicle 12 or a roadside hazard 14, to a vehicle 16 is illustrated in FIG. 1. As shown in FIG. 2, the system 10 comprises a transmitter 18 adapted for placement at the advisory site, such as inside the emergency vehicle 12 or alongside the roadside hazard 14. The system 10 further comprises a receiver 20 adapted for placement inside the vehicle 16.

The transmitter 18 includes a first oscillator 22 for transmitting a first carrier signal having a first predetermined carrier frequency $S_1$ and a second oscillator 24 for transmitting a second carrier signal having second predetermined carrier frequency $S_2$. The transmitter 18 also includes a modulator 26 for modulating both carrier signals with an identical modulating signal M reflective of the traffic situation. The first carrier frequency $S_1$ and the second carrier frequency $S_2$ are spaced apart by a predetermined frequency difference (PFD), preferably 80 MHz.

In one embodiment of the invention, the receiver 20 includes scanning circuitry, such as a conventional programmed microprocessor 28, for scanning across a predetermined frequency range to detect carrier signals separated by the predetermined frequency difference. As is well known, the difference can be determined by utilizing a receiver with a constant sweep rate, and measuring the time between the two frequency detections.

Upon detection of signals separated by the predetermined frequency difference, the microprocessor 28 is used to determine when a message regarding traffic information should be announced. The logic of the receiver's microprocessor 28 is provided in FIG. 3 for this particular embodiment.

Figure 3:
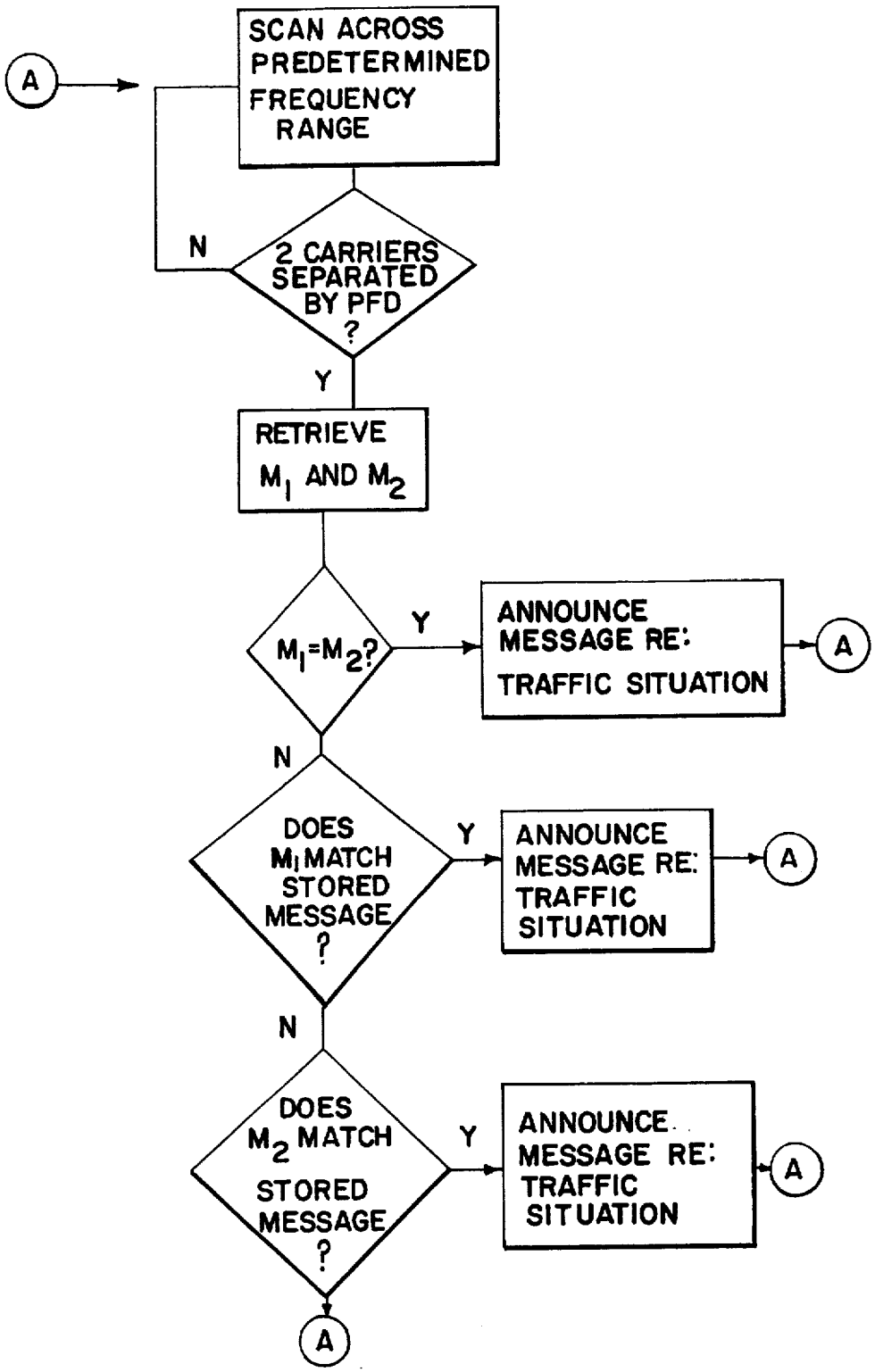
FIG. 3 is a flow diagram of the logic of the receiver's microprocessor for a first embodiment of the invention.

Referring to FIGS. 2 and 3, a demodulator 29 is used to retrieve a first retrieved modulating signal $M_1$ about the first carrier signal and a second retrieved modulating signal $M_2$ about the second carrier signal.

Next, the receiver 20 compares the first retrieved modulating signal $M_1$ to the second retrieved modulating signal $M_2$ and determines whether the first and second retrieved modulating signals $M_1$, $M_2$ are identical. If the first retrieved modulating signal $M_1$ and the second retrieved modulating signal $M_2$ are identical, then the receiver 20 announces a message regarding the traffic situation based upon the identical retrieved modulating signals by referring to a look-up table 30 preferably contained in the memory of the microprocessor 28.

If the first retrieved modulating signal $M_1$ and the second retrieved modulating signal $M_2$ are not identical, such as if one had become distorted in transmission, or if one was received from one transmitter and the other was received from another transmitter, then the receiver 20 compares the first retrieved modulating signal $M_1$ to a series of acceptable stored traffic messages and determines whether the first retrieved modulating signal $M_1$ matches one of the acceptable stored messages through use of the look-up table 30. If the first retrieved modulating signal $M_1$ matches one of the acceptable stored messages, then the receiver 20 announces a message regarding the traffic information based upon the first retrieved modulating signal $M_1$.

If the first retrieved modulating signal $M_1$ does not match one of the acceptable stored messages, then the receiver 20 compares the second retrieved modulating signal $M_2$ to a series of acceptable stored traffic messages stored in the look-up table 30 and determines whether the second retrieved modulating signal matches one of the acceptable stored messages. If the second retrieved modulating signal $M_2$ matches one of the acceptable stored messages, then the receiver 20 announces a message regarding the traffic information based upon the second retrieved modulating signal $M_2$. If it does not, no message is announced.

The receiver 20 may announce the message either via a visual display 31, such as a conventional LCD display, an audible display 32, or both. If an audible display, the message could be announced as one of a plurality of tones, which particular tone would have a pre-arranged and defined meaning for the operator of the vehicle. Alternatively, the audible message could be a stored voice-synthesized message, as is well known.

In this embodiment of the invention, the first predetermined carrier frequency $S_1$ is 24.11 GHz and the second predetermined carrier frequency $S_2$ is 24.19 GHz so that the predetermined frequency difference is 80 MHz as mentioned above. It should be apparent that any two carrier signals having carrier frequencies separated by a predetermined frequency difference may be utilized without departing from the scope of the invention.

Figure 4:
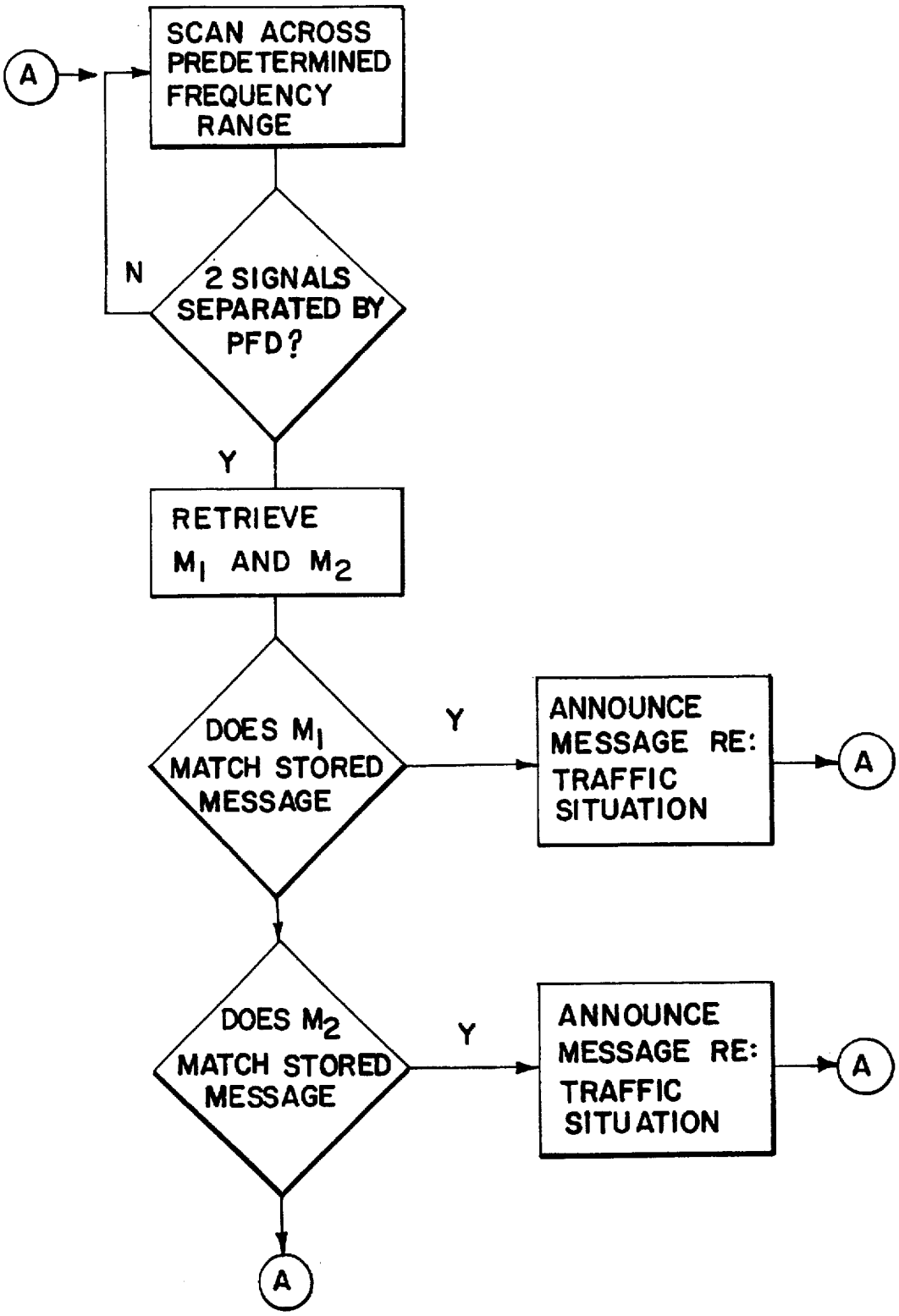
FIG. 4 is a flow diagram of the logic of the receiver's microprocessor for a second embodiment of the invention.

In a second embodiment of the invention, the transmitter 18 is identical to the one described above. On the other hand, the structure and operation of the receiver's microprocessor 28 differs. The logic of the receiver's microprocessor 28 for this embodiment is shown in FIG. 4.

Specifically, the receiver 20 scans across a predetermined frequency range to detect carrier signals separated by the predetermined frequency difference (PFD). In this embodiment like the first embodiment, upon detection of signals separated by the predetermined frequency difference, a demodulator 29 is used to retrieve a first retrieved modulating signal $M_1$ about the first carrier signal and a second retrieved modulating signal $M_2$ about the second carrier signal.

Contrary to the first embodiment, in this embodiment the receiver 20 does not compare the first retrieved modulating signal $M_1$ to the second retrieved modulating signal $M_2$. Instead the receiver 20 compares the first retrieved modulating signal $M_1$ to a series of acceptable stored traffic messages stored in a look-up table 30 and determines whether the first retrieved modulating signal $M_1$ matches one of the acceptable stored messages. If the first retrieved modulating signal $M_1$ matches one of the acceptable stored messages, then the receiver 20 announces a message regarding the traffic information based upon the first retrieved modulating signal $M_1$.

If the first retrieved modulating signal $M_1$ does not match one of the acceptable stored messages, then the receiver 20 compares the second retrieved modulating signal $M_2$ to a series of acceptable stored traffic messages and determines whether the second retrieved modulating signal $M_2$ matches one of the acceptable stored messages in the look-up table 30. If the second retrieved modulating signal $M_2$ matches one of the acceptable stored messages, then the receiver 20 announces a message regarding the traffic information based upon the second retrieved modulating signal $M_2$. If it does not, no message is announced.

Figures 5, 6:
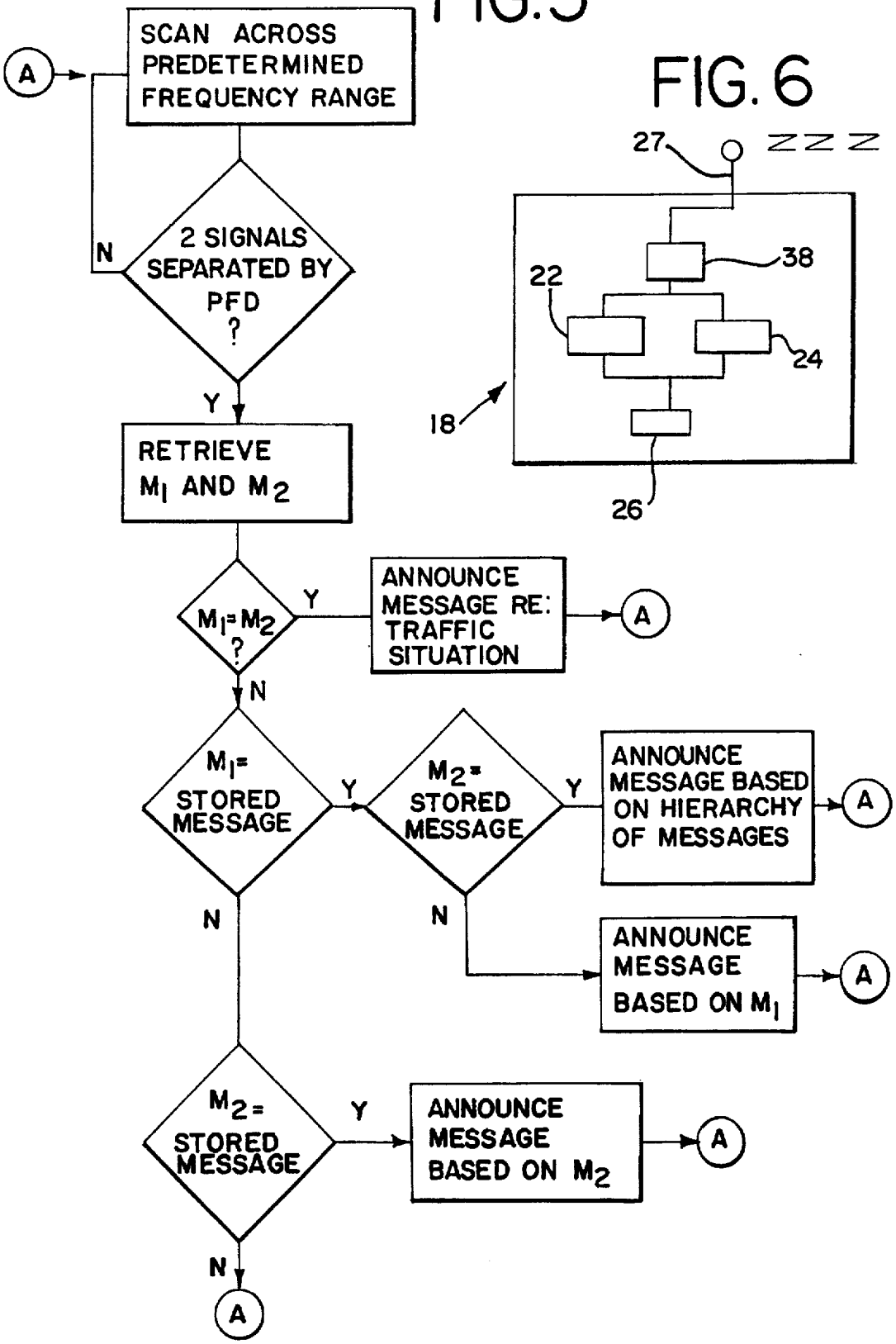
FIG. 5 is a flow diagram of the logic of the receiver's microprocessor for a third embodiment of the invention.
FIG. 6 is a block diagram of another embodiment of the transmitter of FIG. 2 including toggle means.

In a third embodiment of the invention, the transmitter 18 is identical to that of the first embodiment but the structure and operation of the receiver's microprocessor 28 differs from the first embodiment. The logic of the receiver's microprocessor 28 for this embodiment is shown in FIG. 5.

Specifically, the receiver 20 scans across a predetermined frequency range to detect carrier signals separated by the predetermined frequency difference (PFD). Upon detection of signals separated by the predetermined frequency difference, a demodulator 29 is used to retrieve a first retrieved modulating signal $M_1$ about the first carrier signal and a second retrieved modulating signal $M_2$ about the second carrier signal.

Next, the receiver 20 compares the first retrieved modulating signal $M_1$ to the second retrieved modulating signal $M_2$ and determines whether the first and second retrieved modulating signals $M_1$, $M_2$ are identical. If the first retrieved modulating signal $M_1$ and the second retrieved modulating signal $M_2$ are identical, then the receiver 20 announces a message regarding the traffic situation based upon the identical retrieved modulating signals through use of a look-up table 30.

If the first retrieved modulating signal $M_1$ and the second retrieved modulating signal $M_2$ are not identical, then the receiver 20 compares the first retrieved modulating signal $M_1$ to a series of acceptable stored traffic messages contained in the look-up table 30 and determines whether the first retrieved modulating signal $M_1$ matches one of the acceptable stored messages. The receiver 20 also compares the second retrieved modulating signal $M_2$ to a series of acceptable stored traffic messages stored in the look-up table 30 and determines whether the second retrieved modulating signal $M_2$ matches one of the acceptable stored messages.

If both the first retrieved modulating signal $M_1$ and the second retrieved modulating signal $M_2$ match one of the acceptable stored messages, the receiver 20 will then determine which message to announce based upon a predetermined traffic situation hierarchy.

One conceivable situation in which both the first and second retrieved modulating signals may match one of the acceptable stored messages yet be different from one another is when the receiver picks up signals from both a first transmitter, transmitting a first modulating signal at a first carrier frequency, and a second transmitter, transmitting a second modulating signal at a second carrier frequency, and the two carrier frequencies are separated by the predetermined frequency difference.

In such case, the first retrieved modulating signal $M_1$ may indicate the presence of a roadside hazard while the second retrieved modulating signal $M_2$ may indicate the presence of an emergency vehicle. Assuming the predetermined traffic situation hierarchy placed emergency vehicles "above" roadside hazards, then the receiver 20 would announce a message indicating the presence of a traffic situation involving an emergency vehicle.

Referring back to FIG. 5, if the first retrieved modulating signal $M_1$ did not match one of the acceptable stored messages after the receiver 20 determined that the first retrieved modulating signal $M_1$ and the second retrieved modulating signal $M_2$ were not identical, then the receiver 20 compares the second retrieved modulating signal $M_2$ to a series of acceptable stored traffic messages stored in the look-up table 30 and determines whether the second retrieved modulating signal matches one of the acceptable stored messages. If the second retrieved modulating signal $M_2$ matches one of the acceptable stored messages, then the receiver 20 announces a message regarding the traffic information based upon the second retrieved modulating signal $M_2$. If it does not, no message is announced.

As an alternative to comparing whether the first and second retrieved modulating signals $M_1$, $M_2$ are identical immediately upon retrieval, this step could be performed after determining whether both the first and second retrieved modulating signals $M_1$, $M_2$ match acceptable stored messages in the look-up table 30. If the first and second retrieved modulating signals $M_2$, $M_1$ were found to be identical, then the receiver 20 would announce a message regarding the traffic information based on the identical retrieved signal. However, if the first and second retrieved modulating signals $M_1$, $M_2$ were found to be different, then the receiver 20 would determine which message to announce based upon a predetermined traffic situation hierarchy.

In a fourth embodiment of the invention, the transmitter 18 is again identical to the one described in the first embodiment, but the structure and operation of the receiver's microprocessor 28 differs.

Specifically, instead of scanning across a predetermined frequency range, the receiver 20 "looks" to two specific carrier frequencies to detect the presence of the first carrier signal and the second carrier signal at those frequencies. For example, the receiver 20 would specifically look for one signal at 24.11 GHz and another signal at 24.19 GHz.

Upon detection of these signals, the receiver 20 would then retrieve first and second retrieved modulating signals $M_1$, $M_2$ about the two specific carrier frequencies and would announce a message regarding a traffic situation using the logic of any one of the three embodiments described above.

A fifth embodiment of the invention combines the inventions described in Ser. No. 08/297,969 filed Aug. 30, 1994, now U.S. Pat. No. 5,497,148 with the invention described herein. Accordingly, Ser. No. 08/297,969 now U.S. Pat. No. 5,497,148 is specifically incorporated herein by reference.

In the fifth embodiment of the invention, detection of two carrier signals separated by a specific frequency distance would indicate the presence of a particular type of traffic situation. Each of the carrier signals would be modulated with an identical modulating signal M. The modulating signal M could then be used to indicate further information.

For example, detecting two signals separated by a frequency difference of 120 MHz could indicate the presence of an emergency vehicle. The modulating signal M could add to that information by indicating that the emergency vehicle is a police car or alternatively an ambulance, or the like.

Thus, the same modulated signal could have two meanings, depending on the frequency difference of the carrier signals transmitting the modulating signal. This has the further benefit that should the modulated signal be distorted, the primary signal (i.e., based on the carrier frequency difference) would still be detected and communicated.

Referring back to FIG. 2, the transmitter 18 and the receiver 20 are shown having antennas 27, 37 respectively. These antennas 27, 37 can take on various forms. It is preferred, however, that the antenna 27 for the transmitter 18 include a pair of patch antennas for each oscillator. The structure and operation of patch antennas are well-known in the art. Additionally, it is also anticipated that the antenna 37 for the receiver 20 could include a plurality of patch antennas.

Patch antennas are particularly desirable in this application in order to eliminate the need of expensive couplers, thus reducing costs, when using certain other types of antennas. Furthermore, using a pair of patch antennas placed back-to-back in the transmitter 18 provides a nearly omnidirectional transmission of the carrier signals due to the well-known transmission characteristics of patch antennas.

It should also be understood that the modulating signal M can either be a digital signal or an analog signal, such as a tone, depending upon the selection of the designer. In the preferred embodiments described herein, the modulating signal is digital, Finally, in certain situations it may be desirable to provide a toggle system such that the first and second oscillators are toggled on and off so that when the first oscillator is transmitting the second oscillator is not and when the second oscillator is transmitting the first is not. FIG. 6 shows toggle means 38 in block diagram form.

One situation in which a toggle system may be desirable is when like transmitters are in close proixmity with one another. If the rate at which the toggle system turns each one of the oscillators on and off varies for each type of traffic situation, the likelihood of two like transmitters interfering with each other would be minimized, particularly if both oscillators are also pulsed so that neither one is on even 50% of the time.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A traffic information warning system for conveying a message regarding a traffic situation from a traffic advisory site to a vehicle, the system comprising a transmitter adapted for placement at the advisory site and a receiver adapted for placement at the vehicle, wherein:

the transmitter includes a first oscillator for transmitting a first carrier signal and a second oscillator for transmitting a second carrier signal, the first carrier signal having a first carrier frequency and the second carrier signal having a second carrier frequency, a modulator for modulating both carrier signals with an identical modulating signal reflective of a traffic situation, the first carrier frequency and the second carrier frequency being spaced apart by a predetermined frequency difference; and, the receiver includes scanning circuitry for scanning across a predetermined frequency range to detect carrier signals separated by the predetermined frequency difference, a demodulator for retrieving a first retrieved modulating signal about the first carrier signal, means for comparing the first retrieved modulating signal to a series of acceptable stored traffic messages and for determining whether the first retrieved modulating signal matches one of the acceptable stored traffic messages, and means for announcing a message regarding the traffic situation.

2. The traffic information warning system of claim 1 wherein the announcing means includes an audible sound.

3. The traffic information warning system of claim 2 wherein the audible sound is a voice-synthesized message.

4. The traffic information warning system of claim 1 wherein the announcing means includes a visible display.

5. The traffic information warning system of claim 1 wherein the transmitter uses a patch antenna to transmit the first and second carrier signals.

6. The traffic information warning system of claim 1 wherein the transmitter includes a plurality of patch antennas to direct both the first carrier signal and the second carrier signal away from the traffic advisory site.

7. The traffic information warning system of claim 1 wherein the announcing means does not announce a message regarding the traffic situation when the first retrieved modulating signal does not match one of the stored traffic messages and does announce a message regarding the traffic situation where the first retrieved modulating signal matches one of the stored traffic messages.

8. The traffic information warning system of claim 7 wherein the demodulator retrieves a second retrieved modulating signal about the second carrier signal.

9. The traffic information warning system of claim 8 further including means for comparing the second retrieved modulating signal to a series of acceptable stored traffic messages and for determining whether the second retrieved modulating signal matches one of the acceptable stored traffic messages.

10. The traffic information warning system of claim 9 wherein the announcing means does not announce a message regarding the traffic situation when the second retrieved modulating signal does not match one of the stored traffic messages and does announce a message regarding the traffic situation when the second retrieved modulating signal matches one of the stored traffic messages.

11. The traffic information warning system of claim 1 wherein the receiver uses a patch antenna to receive the first and second carrier signals.

12. The traffic information warning system of claim 1 wherein the receiver further includes a plurality of patch antennas to receive the first and second carrier signals.

13. The traffic information warning system of claim 1 wherein the traffic advisory site comprises an emergency vehicle.

14. The traffic information warning system of claim 1 wherein the traffic advisory site comprises a roadside hazard.

15. The traffic information warning system of claim 1 wherein toggle means are provided to toggle the first oscillator and second oscillator on and off, so that when the first oscillator is on the second oscillator is off and when the second oscillator is on the first oscillator is off.

16. A traffic information warning system for conveying a message regarding a traffic situation from a traffic advisory site to a vehicle, the system comprising a transmitter adapted for placement at the advisory site and a receiver adapted for placement at the vehicle, wherein:

the transmitter includes a first oscillator for transmitting a first carrier signal and a second oscillator for transmitting a second carrier signal, the first carrier signal having a first predetermined carrier frequency and the second carrier signal having a second predetermined carrier frequency, a modulator for modulating both carrier signals with an identical modulating signal reflective of a traffic situation; and, the receiver includes a demodulator for retrieving a first retrieved modulating signal about the first carrier signal at the first predetermined carrier frequency, means for comparing the first retrieved modulating signal to a series of acceptable stored traffic messages and for determining whether the first retrieved modulating signal matches one of the acceptable stored traffic messages, and means for announcing a message regarding the traffic situation.

17. The traffic information warning system of claim 16 wherein the announcing means includes an audible sound.

18. The traffic information warning system of claim 17 wherein the audible sound is a voice-synthesized message.

19. The traffic information warning system of claim 16 wherein the announcing means includes a visible display.

20. The traffic information warning system of claim 16 wherein the transmitter uses a patch antenna to transmit the first and second carrier signals.

21. The traffic information warning system of claim 16 wherein the announcing means does not announce a message regarding the traffic situation when the first retrieved modulating signal does not match one of the stored traffic messages and does announce a message regarding the traffic situation when the first retrieved modulating signal matches one of the stored traffic messages.

22. The traffic information warning system of claim 21 wherein the demodulator retrieves a second retrieved modulating signal about the second carrier signal at the second predetermined carrier frequency.

23. The traffic information warning system of claim 22 further including means for comparing the second retrieved modulating signal to a series of acceptable stored traffic messages and for determining whether the second retrieved modulating signal matches one of the acceptable stored messages.

24. The traffic information warning system of claim 23 wherein the announcing means does not announce a message regarding the traffic situation when the second retrieved modulating signal does not match one of the stored traffic messages and does announce a message regarding the traffic situation when the second retrieved modulating signal matches one of the stored traffic messages.

25. The traffic information warning system of claim 16 wherein the receiver uses a patch antenna to receive the first and second carrier signals.

26. The traffic information warning system of claim 16 wherein the traffic advisory site comprises an emergency vehicle.

27. The traffic information warning system of claim 16 wherein the traffic advisory site comprises a roadside hazard.

28. The traffic information warning system of claim 16 wherein toggle means are provided to toggle the first oscillator and second oscillator on and off, so that when the first oscillator is on the second oscillator is off and when the second oscillator is on the first oscillator is off.

29. A traffic information warning system for conveying a message regarding a traffic situation from a traffic advisory site to a vehicle, the system comprising a transmitter adapted for placement at the advisory site and a receiver adapted for placement at the vehicle, wherein:

the transmitter includes a first oscillator for transmitting a first carrier signal and a second oscillator for transmitting a second carrier signal, the first carrier signal having a first carrier frequency and the second carrier signal having a second carrier frequency, a modulator for modulating both carrier signals with an identical modulating signal reflective of a traffic situation, the first carrier frequency and the second carrier frequency being spaced apart by a predetermined frequency difference; and, the receiver includes scanning circuitry for scanning across a predetermined frequency range to detect carrier signals separated by the predetermined frequency difference, a demodulator for retrieving a first retrieved modulating signal about the first carrier signal and a second retrieved modulating signal about the second carrier signal, means for comparing the first retrieved modulating signal to the second retrieved modulating signal and determining whether the first and second retrieved modulating signal are identical, and means for announcing a message regarding the traffic situation.

30. The traffic information warning system of claim 29 wherein the announcing means announces a message regarding the traffic situation when the first retrieved modulating signal and the second retrieved modulating signal are identical.

31. The traffic information warning system of claim 29 wherein the announcing means includes an audible sound.

32. The traffic information warning system of claim 31 wherein the audible sound is a voice-synthesized message.

33. The traffic information warning system of claim 29 wherein the announcing means includes a visible display.

34. The traffic information warning system of claim 29 wherein the transmitter uses a patch antenna to transmit the first and second carrier signals.

35. The traffic information warning system of claim 29 wherein the transmitter includes a plurality of patch antennas to direct both the first carrier signal and the second carrier signal away from the traffic advisory site.

36. The traffic information warning system of claim 29 wherein the announcing means does not announce a message regarding the traffic situation when the first retrieved modulating signal and the second retrieved modulating signal do not match.

37. The traffic information warning system of claim 29 wherein the receiver uses a patch antenna to receive the first and second carrier signals.

38. The traffic information warning system of claim 29 wherein the receiver further includes a plurality of patch antennas to receive the first and second carrier signals.

39. The traffic information warning system of claim 29 wherein the traffic advisory site comprises an emergency vehicle.

40. The traffic information warning system of claim 29 wherein the traffic advisory site comprises a roadside hazard.

41. The traffic information warning system of claim 29 wherein toggle means are provided to toggle the first oscillator and second oscillator on and off, so that when the first oscillator is on the second oscillator is off and when the second oscillator is on the first oscillator is off.

42. The traffic information warning system of claim 29 further including means to compare the first retrieved modulating signal to a series of acceptable stored traffic messages and to determine whether the first retrieved modulating signal matches one of the acceptable stored messages when the first and second retrieved modulating signals are not identical.

43. The traffic information warning system of claim 42 wherein the announcing means does not announce a message regarding the traffic situation when the first retrieved modulating signal does not match one of the stored traffic messages and does announce a message regarding the traffic situation if the first retrieved modulating signal matches one of the stored traffic messages.

44. The traffic information warning system of claim 43 wherein means are provided to compare the second retrieved modulating signal to a series of acceptable stored traffic messages and to determine whether the second retrieved modulating signal matches one of the acceptable stored messages.

45. The traffic information warning system of claim 44 wherein the announcing means does not announce a message regarding the traffic situation when the second retrieved modulating signal does not match one of the stored traffic messages and does announce a message regarding the traffic situation if the second retrieved modulating signal matches one of the stored traffic messages.

46. The traffic information warning system of claim 42 further including means to compare the second retrieved modulating signal to a series of acceptable stored traffic messages and to determine whether the second retrieved modulating signal matches one of the acceptable stored messages when the first and second retrieved modulating signals are not identical.

47. The traffic information warning system of claim 46 further including a predetermined traffic situation hierarchy.

48. The traffic information warning system of claim 47 further including means for determining whether the first retrieved modulating signal is above the second retrieved modulating signal in the predetermined traffic situation hierarchy.

49. The traffic information warning system of claim 48 further including means for announcing a message regarding the traffic situation based upon whether or not the first retrieved modulating signal is above the second retrieved modulating signal in the predetermined traffic situation hierarchy.

50. A traffic information warning system for conveying first and second messages regarding a traffic situation from a traffic advisory site to a vehicle, the system comprising a transmitter adapted for placement at the advisory site and a receiver adapted for placement at the vehicle, wherein:

the transmitter includes a first oscillator for transmitting a first carrier signal and a second oscillator for transmitting a second carrier signal, the first carrier signal having a first discrete carrier frequency and the second carrier signal having a second discrete carrier frequency, the first and second discrete carrier signal frequencies being located at a frequency location and the first message of a traffic situation being reflective of the specific frequency locations of the first and second discrete frequencies, a modulator for modulating both carrier signals with an identical modulating signal reflective of the second message regarding a traffic situation; and, the receiver includes scanning circuitry for scanning across a predetermined frequency range to detect first and second carrier signals, means responsive to the detecting means for determining the first message regarding a traffic situation, a demodulator for retrieving a first retrieved modulating signal about the first carrier signal and a second retrieved modulating signal about the second carrier signal, means for comparing the first retrieved modulating signal to the second retrieved modulating signal and determining whether the first and second retrieved modulating signal are identical, and means for announcing the first and second messages regarding the traffic situation.

51. The traffic information warning of claim 50 wherein the announcing means announces the first and second messages regarding the traffic situation if the first retrieved modulating signal and second retrieved modulating signal are identical.

52. The traffic information warning system of claim 50 wherein the announcing means includes an audible sound.

53. The traffic information warning system of claim 52 wherein the audible sound is a voice-synthesized message.

54. The traffic information warning system of claim 50 wherein the announcing means includes a visible display.

55. The traffic information warning system of claim 50 wherein the transmitter uses a patch antenna to transmit the first and second carrier signals.

56. The traffic information warning system of claim 50 wherein the transmitter includes a plurality of patch antennas to direct both the first carrier signal and the second carrier signal away from the traffic advisory site.

57. The traffic information warning system of claim 50 wherein the announcing means does not announce a message regarding the traffic situation when the first retrieved modulating signal and the second retrieved modulating signal do not match.

58. The traffic information warning system of claim 50 wherein the receiver uses a patch antenna to receive the first and second carrier signals.

59. The traffic information warning system of claim 50 wherein the receiver further includes a plurality of patch antennas to receive the first and second carrier signals.

60. The traffic information warning system of claim 50 wherein the traffic advisory site comprises an emergency vehicle.

61. The traffic information warning system of claim 50 wherein the traffic advisory site comprises a roadside hazard.

62. The traffic information warning system of claim 50 wherein toggle means are provided to toggle the first oscillator and second oscillator on and off, so that when the first oscillator is on the second oscillator is off and when the second oscillator is on the first oscillator is off.

* * * * *